United States Patent [19]

Doucette

[11] 3,935,967

[45] Feb. 3, 1976

[54] APPARATUS FOR FEEDING SHELL-LIKE ARTICLES

[75] Inventor: Eugene F. Doucette, Burlington, Mass.

[73] Assignee: Owens-Illinois, Inc., Toledo, Ohio

[22] Filed: Aug. 28, 1974

[21] Appl. No.: 501,143

Related U.S. Application Data

[62] Division of Ser. No. 416,733, Nov. 19, 1973, Pat. No. 3,867,807.

[52] U.S. Cl. ..... 221/222; 221/236

[51] Int. Cl.² ..... B65H 3/28

[58] Field of Search ..... 221/222, 224, 236

[56] References Cited

UNITED STATES PATENTS

| | | | |
|---|---|---|---|
| 2,385,267 | 9/1945 | Franz | 221/236 X |
| 2,721,002 | 10/1955 | Smith | 221/222 |
| 2,942,758 | 6/1960 | Hogstrom | 221/222 |
| 3,137,982 | 6/1964 | Decker et al. | 221/222 X |
| 3,426,941 | 2/1969 | Hovekamp | 221/222 |

*Primary Examiner*—Robert B. Reeves
*Assistant Examiner*—Francis J. Bartuska
*Attorney, Agent, or Firm*—J. R. Nelson

[57] ABSTRACT

The invention disclosed is a machine for applying in series a molded plastic shell-like carrier over a prearranged grouping of containers, such as bottles. The machine includes a storage magazine turret supplying the carriers in nested fashion to a hopper device at a feeding station. The magazine turret indexes a magazine to the feeding station and a cam-operated device releases the nested carrier stack in a magazine to the underlying hopper. A carrier feed device continuously separates the lowermost carrier and drops it to an underlying carrier delivery conveyor. Bottles are advanced in parallel rows under the conveyor and past a carrier gate at the end of the carrier conveyor. First star wheel mechanism spaces the bottles on the conveyor to correspond as groups with compartment cavities in the carrier. Bottles moving through the first star wheel pull carriers from the feed gate; whereupon each such carrier falls over a group of bottles. A horizontal overhead guide rail holds down the carrier in a preliminary position of assembly whereat the bottles are each inserted into a compartment cavity of the carrier. The bottle conveyor moves bottles and carriers through a second star wheel device stabilizing the bottles under a rotary applicator wheel. The wheel has peripherally spaced pockets that coincide with the compartments of the carrier and the wheel, on a yieldable arm, bears against the carrier to seat the annular retaining bead in the carrier compartments over an enlarged end portion of the bottles. The grouping of bottles is held in the carrier as a packaged unit.

3 Claims, 8 Drawing Figures

APPARATUS FOR FEEDING SHELL-LIKE ARTICLES

This is a division of application Ser. No. 416,733, filed Nov. 19, 1973 now U.S. Pat. No. 3,867,807.

CARRIER APPLICATOR MACHINE FOR BOTTLES

There is devised a container carrier that is molded from plastic as a shell-like article having upstanding cells or compartments each provided with an internal annular bead or radial flange adapted to receive the neck and closure of a bottle product and retain the bottle in position in the compartment. Thusly, the group of product bottles comprise a carrier package. These carrier packages are often referred to as "six-paks" or "eight-paks", and most commonly used in the handling and marketing of carbonated beverages and beer products. This form of carrier is disclosed in U.S. Pat. No. 3,752,305 and copending application, Ser. No. 294,171 of J. Hatfield, filed Oct. 2, 1972, now U.S. Pat. No. 3,871,699 commonly owned with the present application.

The present invention provides a machine for the continuous assembly of a supply of containers or bottles into carrying packages with the aforementioned type of shell-like carrier.

The applicator machine provides a production capacity in fabricating and handling the assembled carrier packages. One sub-assembly of the machine provides for continuous supply of the plastic carriers that are stacked or nested in plural magazines. The several magazines are each on a radial arm of a turret that is indexed periodically about a vertical shaft. The turret is located at an upper level and the carriers are forced through the vertical magazines by gravity. At the bottom end of each magazine there are pivotally mounted carrier stack support bars. These are normally biased to close the lower end of the magazine and retain the stack of carriers in the magazine. By control system to the turret index drive, a magazine is advanced to a position at the carrier feed station. A full magazine, for example, is advanced into the feed station upon a photo beam signal that a prior magazine has been emptied of carriers, or is in fact empty. As the new magazine moves into place at the feed station by turret index, a cam follower of the carrier support arms (normally closed) engages a stationary cam on the frame of the machine in proximity of the feed station. The cam actuates the support bars to an "open" position, and a stack of carriers in this magazine is released for flow by gravity along the magazine vertical axis.

Underneath the magazine, just mentioned, is the feed station which is comprised of a hopper and the carrier feeder mechanism mounted in stationary position on the machine. The hopper receives the overhead stack of carriers and feeds carriers one at a time onto a carrier delivery belt. The belt single lines the carriers at a gate where each unit group of bottles passing through the machine picks up a carrier that is applied over the bottles. The carrier feeder includes the hopper comprised of a walled chute or box-like frame; and, four rotary feed worms are positioned at the corners along the bottom edge of the hopper frame. The feed worms are rotated in unison at a synchronous rate with carrier belt and bottle movement. Each of the wheels includes a helix land or surface engaging in succession the lower radial flange of the carriers in the stack. The helix surface is rotated such that it separates the lowermost carrier from the stack in the hopper and drops it from the lower, exit end of the feed chute onto the carrier delivery belt. The rest of the stack in the hopper is retained by the corner feed worms. The carriers in nested relationship as a stack in the hopper do have a tendency to stick together as a stack. The helical feed worms serve to separate the lowermost carrier from the stack, and then after such separation, drop the carrier out of the end of the carrier feed chute. The feed worms of the invention assure the individual separation of successive carriers and feeding them singly onto the moving carrier belt.

Just below the carrier feeder is a horizontal upper reach of an endless delivery belt followed by a downwardly inclined reach of the belt. The carriers drop from the feeder hopper by gravity onto this horizontal portion of the belt. This belt is timed in movement with rate function of the machine so as to receive the carriers from the feed device without interference or overlap and the carriers are laid in a single line on the belt. The carrier delivery belt, after traversing the horizontal span under the feeder worms, extends down the incline toward an end-turn and in a reversing direction. At the end of the inclined span of the belt, a pair of carrier retaining rods are fixed in position to normally prohibit carriers from falling from the end of the incline without further assistance, such as pulling them from the rods. Each carrier on the belt is held up by the retaining rods at this point until positively removed; which, in essence, defines the carrier gate at the end of the carrier delivery conveyor.

The bottle supply conveyor is positioned on the machine to extend under the carrier gate. The carrier delivery belt is operated at a linear speed to maintain a group of two or three carriers in end-to-end fashion backed up from the gate. In this manner, there is assured a carrier at the gate as the bottles in groups move along the path past the gate and just beneath it. There will be no gap between the carriers in this mode of operation.

Along either side of the bottle conveyor just before the point where the bottles enter into engagement with a carrier in the gate, there is a first set of pocketed star wheels. The set is comprised of a star wheel on either side of the conveyor so that the pockets engage the sides of the rows of bottles controlling their movement. The star wheels receive the bottles in the two rows and maintain their positioning in-line in the rows and laterally on the conveyor. The pockets of the star wheels further stabilize the bottles just prior to the carrier pick up from the gate. The set of star wheels are driven in synchronism one to the other and are driven at a rate compatible with the bottle conveyor.

As the leading pair of bottles in the two rows pass below the carrier gate, they engage the underside surface of a carrier protruding into the bottle path. The forward movement of the bottle group (six or eight) drags the carrier from the gate to fall over the top of the bottle group. Thereafter, the carrier moves with this bottle group.

Beyond the carrier gate there is an overhead horizontal guide bar supported on the machine frame and extending for a distance along the bottle conveyor. The guide bar assures that the carrier will remain in an initially assembled position over the bottle group until it passes through the rotary applicator wheel. The applicator wheel includes peripheral pockets spaced on radial centers of the wheel that correspond with center-to-center spacing of the compartments of the carrier. As the bottles move under the applicator wheel, a second set of opposed star wheels mesh with the rows of the bottle group to stabilize them in movement through the applicator wheel. The rolling action of the applicator wheel over the carrier top snaps the retaining bead in the compartments of the carrier over the enlargement on the top end of each bottle in the group to retain them in the carrier. The means of retaining the bottle in the carrier is set forth in detail in the aforementioned patent and application.

The invention therefore resides in the machine and its component parts for efficiently and economically packaging container articles in contoured shell-like carriers.

The invention further provides a machine that is capable of assembling containers in carriers to form assembled packs of containers for carrying and producing them at a high rate of production.

Other aspects of the invention including further advantages provided thereby will become apparent from the following description of the exemplary form of the invention illustrated in the drawings, on which:

DESCRIPTION OF THE INVENTION

On the drawings is shown a bottle carrier applicator machine which will automatically dispense and apply carriers for 6-pack or 8-pack bottle groupings at relatively high rates of production, i.e. on the order of 800 bottles per minute.

The Carrier Applicator Machine

Figure 1:
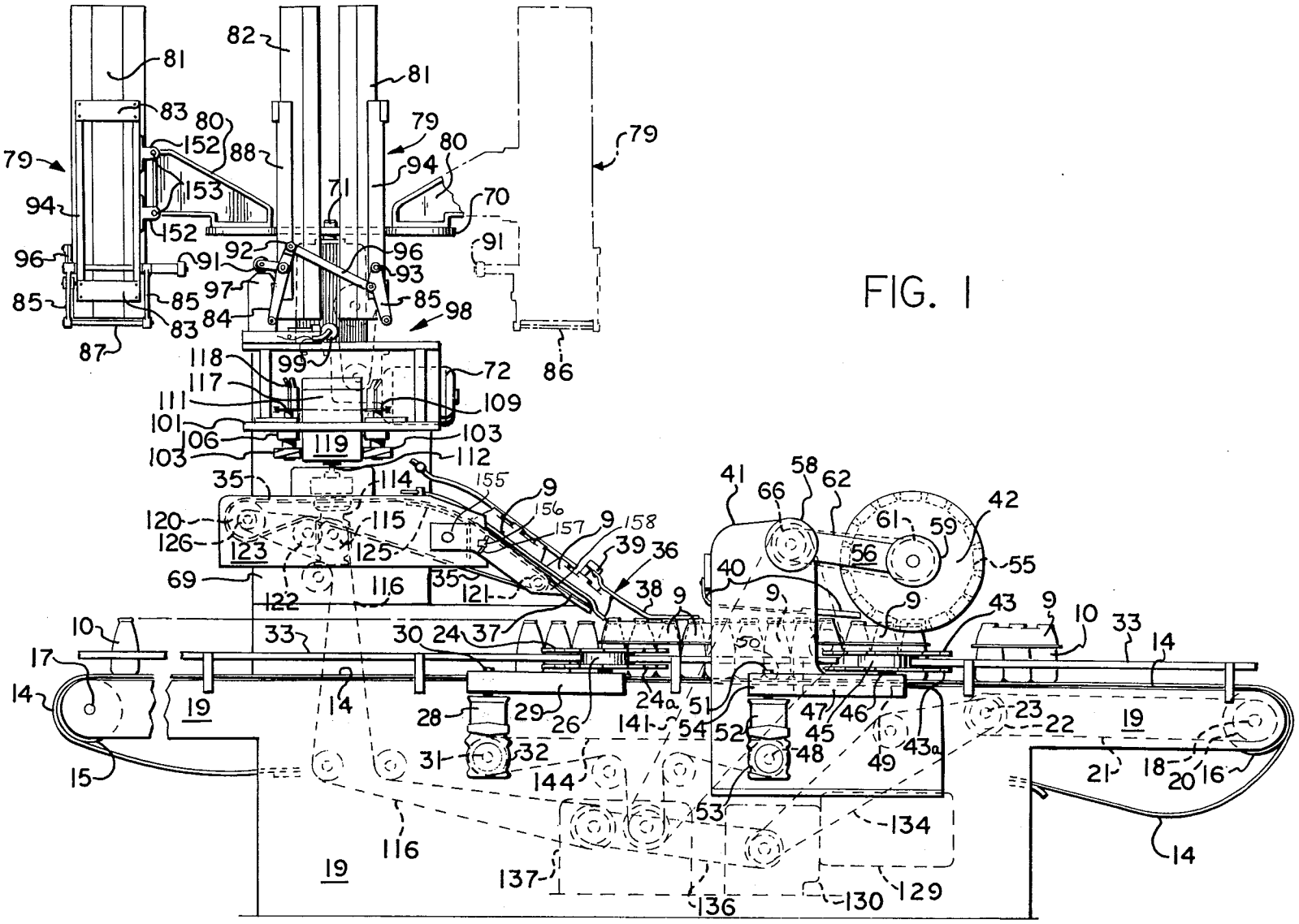
FIG. 1 is a side elevational view of the machine.

The supply of bottles 10 filled with product, such as carbonated beverage or beer, advances them in two parallel rows from the left-hand side of FIG. 1. The bottles 10 have a top closure 11 that provides a lip enlargement 12 (FIG. 7) at the top end. In one form of bottles 10 shown on FIG. 7, the major portion of the body side wall is covered with a layer of plastic 13 such as a shrunken sleeve of foamed polystyrene on the order of 30–35 mils in thickness. This layer coupled with the carrier 9 after it is applied provided substantially total light protection and scratch resistance protection for the glass bottle. However, the invention is not limited by the type of bottle that is packed into the carrier 9, nor is the plastic layer 13 essential to the invention. The disclosed embodiment merely illustrates the versatility of the type of package that may be constructed using the invention.

Bottles 10 in one form or another are advanced by delivery conveyor equipment (not shown) onto the conveyor 14 (FIG. 1), which extends longitudinally through the Applicator Machine. Conveyor 14 is reeved over end pulleys 15 and 16 pivotally mounted on shafts 17 and 18, respectively, mounted for rotation in the machine frame structure 19. Shaft 18 at the exit end of the machine includes a sprocket 20 connected thereon for driving the conveyor. Power is transmitted to sprocket 20 by chain 21 trained over drive gear 22 keyed on a horizontal shaft 23. Synchronized drive system for powering the conveyor and other assemblies will be described hereinafter.

Figure 2:
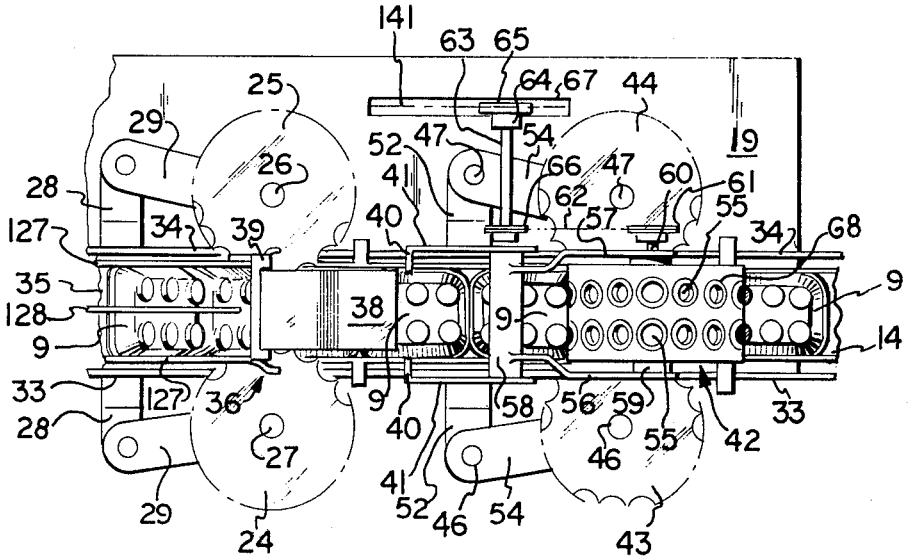
FIG. 2 is a top plan view of the carrier assembly station on the machine of FIG. 1.

The two lines of bottles are carried forward into engagement with a first set of opposed star wheels 24 and 25 (FIG. 2). Each star wheel 24 includes an upper star 24 and lower star **24*a* attached to a central hub 26 which vertically spaces the two stars. The pockets at the periphery of stars 24, 24*a* are shaped to correspond to the size (diameter) and shape of the particular bottle in production. Similarly, star wheel 25 includes an upper star 25 and lower star 25*a* on a spacer-hub 27. The assemblies 24 and 25 are therefore essentially duplicates, but will be driven in counter rotation to each other for controlled feeding of the bottles. The spacer-hubs 26 and 27 of the two star wheels each includes a vertical shaft which extends below the bottom star wheel, 24*a* and 25*a*, respectively. The shafts each include a timing sprocket keyed thereon for rotating the star wheels and this sprocket is connected through a drive train, such as a timing belt, (not shown) to a sprocket of a right angle gear box unit 28. The drive train between hub 26 and gear box 28 is enclosed by a guard 29. Gear box 28 has a vertical output shaft 30 and a lower horizontal power input shaft 31, the latter being driven by a sprocket 32** connected in the main drive system, to be described.

The pockets of the opposed star wheels are arranged in radial, angular spacing on the wheels 24 and 25 to receive the bottles and maintain precise center-to-center spacing of the bottles in each row and stabilize the bottles of the two rows prior to pick-up of the bottle carrier 9. The opposed stars 24 and 25 extend inwardly of the stationary side rail assemblies 33 and 34 mounted on frame 19 along the sides of conveyor 14 and the pockets of the stars 24 and 25 mesh with the bottles to achieve this bottle spacing and stabilizing effect. The stars 24 and 25 are driven in opposite directions of rotation in synchronism with each other and with the line speed of the machine by the drive system.

The carriers 9 are advanced by the overhead carrier delivery belt 35 that is inclined downwardly at a carrier assembly gate (indicated generally at 36) which comprises an inclined dead plate section 37 and overhead hold down guide 38. Guide 38 is pivotally mounted at 39 on the upper carrier feeding assembly, to be described presently in more detail, and is tensioned by spring means (not shown) normally tending to rotate hold down guide 38 clockwise on FIG. 1 into top engagement with a carrier 9. The guide 38 includes the upstream inclined segment attached to the pivot 39 and a terminal segment that extends horizontally when engaging the carrier top on a bottle grouping. The lowermost corner of a carrier 9 extends beyond the forward edge of dead plate 37 in the path of an oncoming grouping of bottles 10 on conveyor 14 as the grouping is in mesh with the first star wheel means 24, 25 (FIG. 1). As this bottle grouping advances further, the front pair of bottles 10 thereof engages the front wall of this carrier 9 held in the carrier assembly gate 36 and pulls the carrier therefrom with the advance of the bottles. The trailing end of the carrier will leave the end of dead plate section 37 and rock down over the grouping of bottles 10 therebeneath assisted by hold down guide 38. One such carrier 9 is shown in place over the bottle grouping near the middle of FIG. 1. This performs the initial assembly function of the carrier on the bottles.

Thereafter, the bottle grouping and carrier advances by the conveyor 14 toward final application of the carrier on the bottles. A spring-like hold down shoe 40 is mounted in relatively fixed position on the upper frame 41 for the applicator wheel. This retains the carrier 9 in place over the bottle grouping during movement thereof into the applicator wheel 42.

Beneath and just ahead of the applicator wheel 42 there is a second star wheel means comprised of opposed star wheels 43 and 44. The star wheels in this second set are made up similar to the first set, described above. The star wheel (FIG. 1) includes an upper star 43 and a spaced lower star 43*a* separated by the spacer-hub 45. The pockets of the stars are shaped to conform to the bottles being processed, as were the star pockets of the first star wheel means described earlier herein. The star wheels 43 and 44 are rotated in counter directions to maintain the bottle grouping in oriented position and advance them without undue bottle-to-bottle contact. The stars 43 and 44 are each on vertical shafts 46 and 47, respectively, and the lower end of shafts 46 and 47 are each connected with a timing sprocket that meshes with a timing belt 49 extending around drive sprocket 50 on the upper end of vertical output shaft 51 of the right angle gear box 52. The horizontal input shaft 48 of the gear box 52 has a drive sprocket 53 keyed thereon which receives power from the drive system, to be presently described. The timing belt 49 is covered with a safety guard 54.

The final application of carrier 9 to a bottle group is accomplished at the final assembly station located beneath applicator wheel 42 while the group of bottles is under guidance of the second star wheel means, and while the star pockets of stars 43 and 44 and the transverse rows of applicator wheel pockets 55 move in synchronism toward a diametric, vertical center plane of wheel 42. At this point, the carrier is fully on two bottles. The peripheral speed of applicator wheel 42 matches the linear speed of the bottles at this point resulting in a "roll-on" action of the carrier to the group of bottles.

Figure 7:
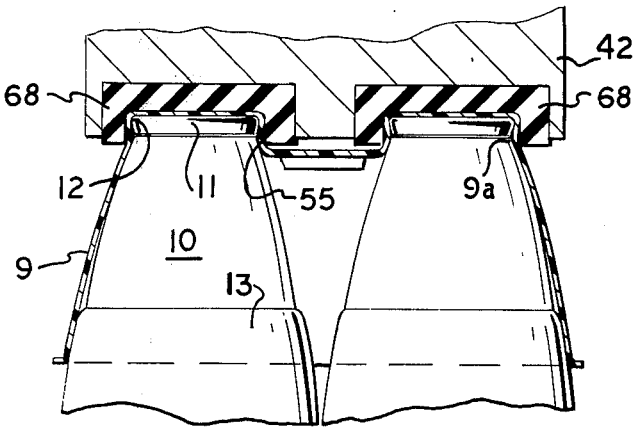
FIG. 7 is a fragmentary, sectional view of the applicator wheel of the machine, shown seating the carrier sockets on the upper ends of containers advancing beneath the applicator wheel.

Applicator wheel 42 is supported by a pair of bifurcated side arms 56 and 57 integrally connected with the bearing trunion 58 that is rotatably supported at its ends in the upper frame 41. The trunion 58 is allowed to pivot and therefore the applicator wheel is allowed to yield vertically, so that the pockets 55 mesh with the cell tops of the of the carrier 9 (FIG. 7). The hub 59 of wheel 42 is connected to horizontal shaft 60 that extends through side arm 57 and is rotated by a sprocket 61 keyed on the outer end thereof. A horizontal shaft 63 is rotatably mounted at one end in upper frame 41 and is rotatable in a bearing 64 on the frame near its other end. A sprocket 65 is keyed on the outer end of shaft 63. A drive chain 62 is on running engagement with sprocket 66 keyed on the opposite end of shaft 63 and sprocket 61 on applicator wheel shaft 60. The applicator wheel 42 is rotated counter clockwise on FIG. 1 by a chain 141 of the drive system that passes through a slot 67 in the horizontal deck of frame 19. The drive system, as will be presently described, operates the applicator wheel 42 in synchronism with the lineal movement of conveyor 14 and star wheels 43 and 44.

In the event of any mis-alignment of the bottles and the applicator wheel pockets 55, the applicator wheel 42 will be free to lift as needed by the yieldable type of mounting support, thus preventing any bottle breakage.

The applicator wheel 42 is constructed with rubber inserts 68 held in the periphery of the wheel to define the wheel pockets 55. The inserts are preferably relatively soft and yieldable to prevent damage to the bottle carrier and bottles in the final assembly stage. The wheel 42 having a downward force component by its weight will exert a peripheral force downwardly at the base of each carrier cell neck to relatively nest the cells of the carrier in the pockets 55 and in turn snap on the cell of the carrier over the end enlargement 12 of the bottle and closure. The upper end of the carrier cells in a relaxed state contain the interior bead 9a that is of a lesser diameter than the bottle's enlarged diameter at the end section 12 (FIG. 7). Therefore, in pressing the carrier at the pocket 55 the plastic of the carrier is enlarged in a force fit over the end section of the bottle until the carrier is in place on the bottle grouping. In such a position, the bottles are individually held in the carrier cells at the annular bead 9*a* of the carrier and a resulting carrying pack of bottled product is formed.

As shown on FIG. 1, the carrying pack of assembled bottles and carrier are moved beyond applicator wheel 42 by conveyor 14. At this point, the carrying packs of product may be oriented and fed into cases or pallet loads or both for subsequent handling.

The Automatic Carrier Feed Mechanism

Attached to operate in conjunction with the carrier applying machine, just described, is an automatic carrier supply and feed device.

Referring to FIGS. 1 and 3–6, the device is supported on an upright frame 69 that is in part columnar in structure. The frame 69 may be connected to machine frame 19 or may be separated. The upper part of frame 69 provides a base for mounting rotary turret 70 by vertical pintle shaft 71. The shaft 71 is connected with the output shaft of an intermittently indexing drive means, generally shown on FIGS. 1 and 4. One such indexing drive means may be purchased from Commercial Cam and Machine Co., Chicago, Illinois, Model No. CC8H32-270. The detailed description of this drive means is shown and described in one or more of the following U.S. Pat. Nos.: 2,986,949; 3,282,387; 2,999,311; 3,525,268 and 3,049,017. The indexing drive includes an electric motor 72 operated by a controller to index the turret one-eighth revolution or one position at a time. In the turret of the present disclosure of the invention, one revolution is accomplished through 8 indexing movements; however, any number of indexes per revolution may be obtained by control of the motor drive 72. The motor controller is operated in response to a photocell 100 located just below the level of the magazine 79 of the mechanism. When the photo beam is interrupted, the controller keeps motor 72 in an inactive state. After the stack of carriers diminishes so as to project the light beam onto the photocell 100, the magazine turret 71 will index one station or one-eighth revolution. If the magazine at the next station is empty so that carriers do not interrupt the beam, the motor 72 is immediately energized to advance turret 71 another station, etc. until a loaded magazine is in position to interrupt the beam.

The motor 72 is connected to operate a gear reduction unit 73 having a drive sprocket 74. The input shaft 75 of the turret drive includes a sprocket 76 connected thereon and power is transmitted between sprockets 74 and 76 by a drive chain 77. As is schematically indicated on FIG. 4, the input shaft 75 and turret shaft 71 are drivingly connected by the aforementioned indexing drive unit indicated generally at 78.

Figure 3:
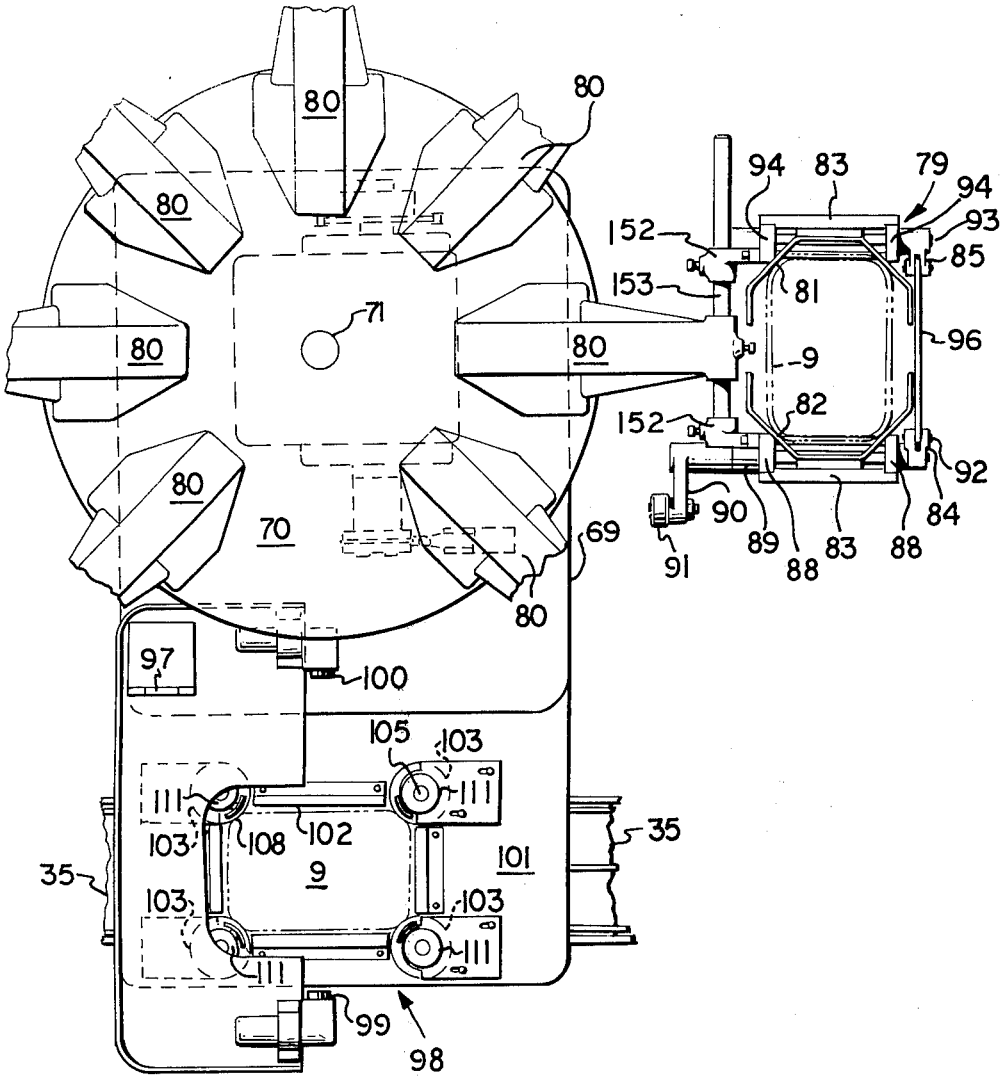
FIG. 3 is a top plan view of the carrier supply turret and carrier feeding station on the machine.
Figure 4:
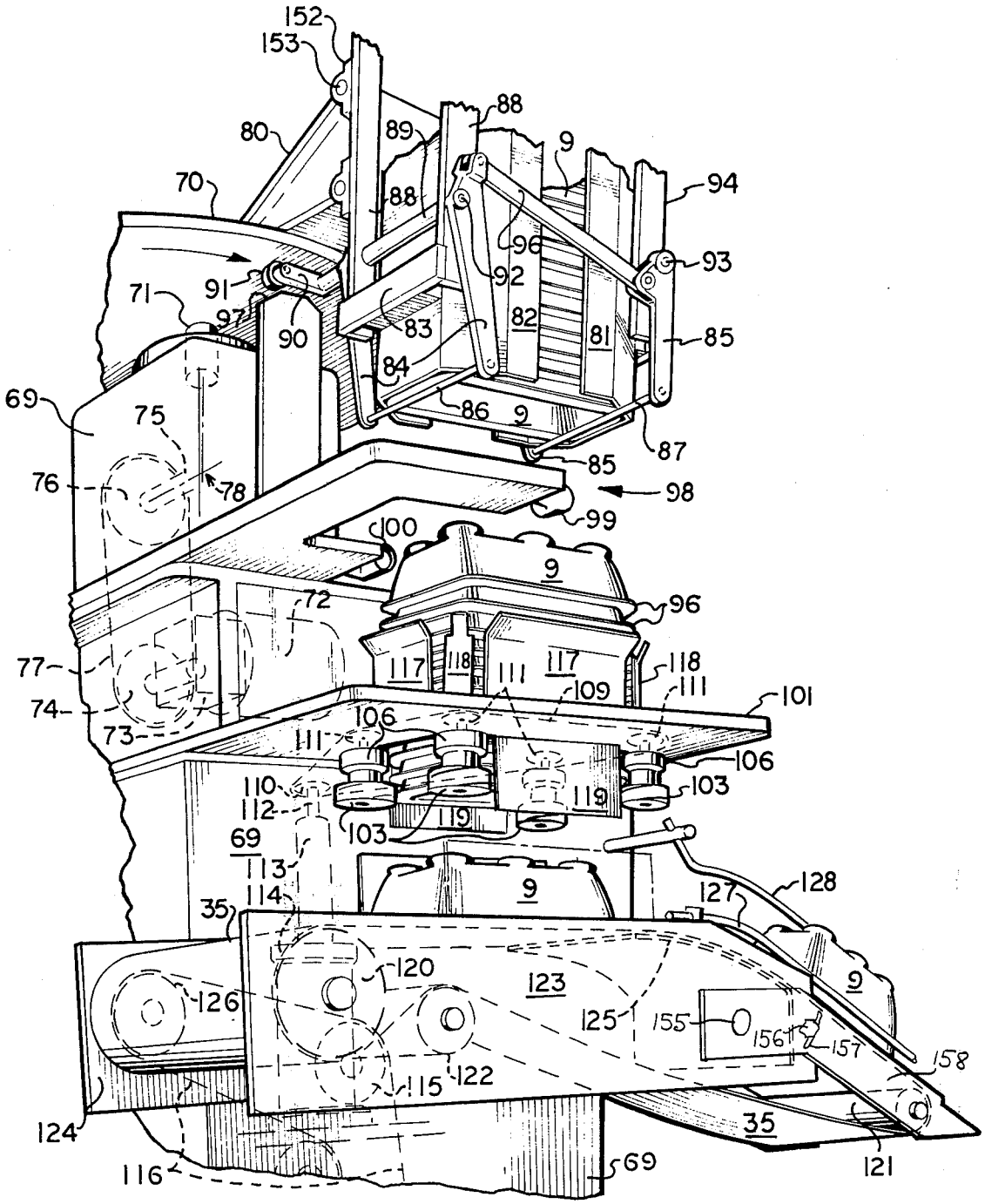
FIG. 4 is a side perspective view of the carrier turret, feeding mechanism and carrier delivery belt of the machine.
Figure 6:
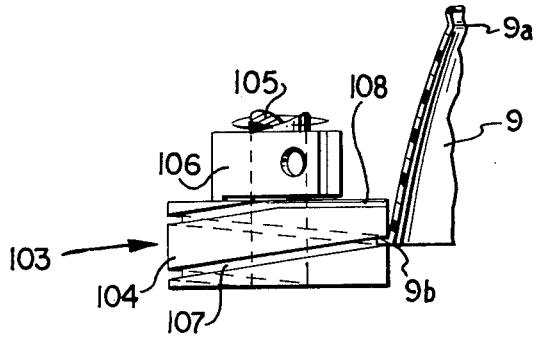
FIG. 6 is a partially sectioned, fragmentary view taken along line 6—6 on FIG. 5, illustrating one of the four corner feeding worms in engagement with the peripheral radial flange of a carrier.
Figure 5:
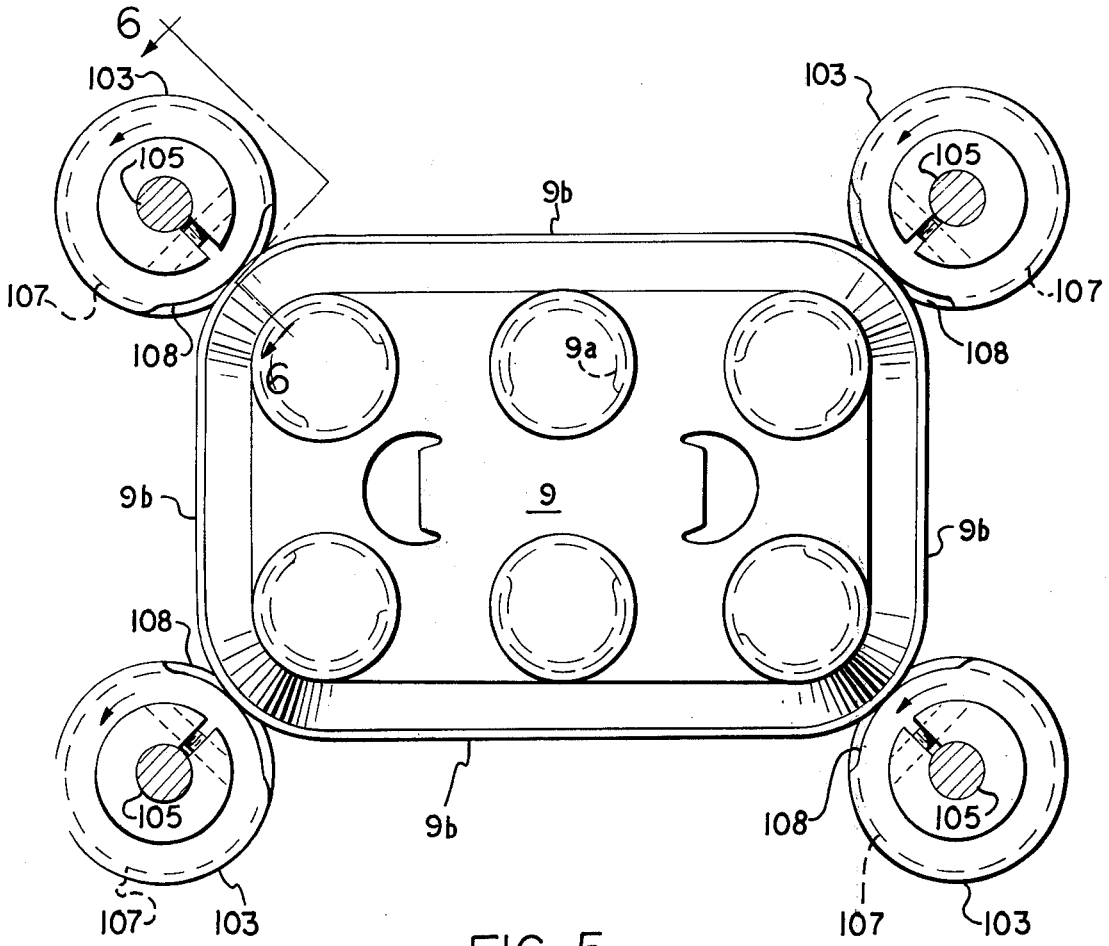
FIG. 5 is a fragmentary sectional plan view of the carrier feeding worms shown in FIG. 3.

Referring to FIGS. 1 and 3, the turret 71 includes plural carrier magazines 79 that are fastened to the turret at equal peripheral intervals thereon by the radial arms 80. In the example shown on the drawings (FIG. 3), there are eight identical magazines 79 on turret 71. For sake of simplicity on the drawings in FIGS. 1, 3 and 4, some of the magazines 79 are omitted from the showing. Each magazine 79 is constructed as a vertical chute having upright and opposed wall members 81 and 82 that define a vertical opening for the passage of a stack of nested carriers 9. The wall members 81 and 82 are connected by lateral elements 83 and the box frame made by walls 81, 82 and elements 83 is fastened to a radial arm 80 by vertically spaced brackets 152 and cross-pins 153 extending through brackets 152 and apertures in the outer end of radial arm 80.

Each magazine 79 will hold a stack of several nested carriers 9, say about 80 such carriers to the stack. The stack is retained in the magazine by two pairs of rocker arms 84 and 85 that position two carrier stack support bars 86 and 87 across the lower end of the magazine chute. The support bars 86 and 87 are each end connected across the bottom end of the pairs of rocker arms 84 and 85, respectively. The first pair of rocker arms 84 are pivotally connected on the vertical members 88 of the magazine mounting frame rigidly connected with the lateral elements 83 thereof by the rock shaft 89. Shaft 89 includes a crank arm 90 on the inner end thereof and on the outer end of arm 90 there is a rotatably connected cam follower 91 (see FIG. 4). Clockwise rotation (rocking movement) of arm 90 moves the first pair of rocker arms 84 outwardly (FIG. 4) about pivot point 92 which in turn moves the stack support bar 86 out of its position for supporting carriers in the chute. The pair of rocker arms 85 are pivotally mounted at their upper end by a pivot pin 93 extending laterally across the opposite vertical members 94 of the magazine. The upper end of rocker arm 84 above pivot 92 on one side of the magazine is connected at the pin 95 to an intermediate point on the opposite rocker arm 85 by a rod 96, whereby movement of arm 84 clockwise drives arm 85 counter clockwise about the pivot pin 93 and moves the second stack support bar 87 from its position for supporting the carriers in the chute. The bars 86 and 87 are moved in unison responsive to cam action between their "closed" and "open" positions with respect to the magazine chute. The cam follower 91 is carried by each of the magazines 79 in the path of a stationary plate cam 97 mounted on the frame structure. The cam 97 is located to trip or raise each cam follower of the magazines at the time each magazine enters a carrier feeding station, indicated at 98 on FIGS. 3 and 4. The "open" position of the support bars 86, 87 is shown on FIG. 1 at station 98. The indexing drive 72, 73 is under control of an "electric eye" comprised of a light source and a photocell 100 (FIG. 3). Photocell 100 is in the control circuit for the motor 72. The light beam is transmitted across the feeding station 98 and if a stack of carriers extends above the level of the light beam so as to break it, as shown on FIG. 4, the drive for the turret 71 remains de-energized. As soon as the level of the carrier stack at station 98 descends below the light beam, the turret drive is energized to advance the next magazine 79 into the feeding station. As this next magazine arrives at station 98, cam 97 opens the lower end of the chute of the magazine by pivoting the support bars 86, 87 in the manner described. The stack of carriers in the magazine falls by gravity onto the carriers piled below at station 98.

The photocell level placement on the machine assures a stack of carriers in the hopper 117–119 above the feeder assembly to assure a supply or stack of carriers during the time it takes to index the next magazine 79 into position and "open" the support bars to release the next stack of carriers into the hopper.

The stack of carriers is now under control of the means for separating and feeding carriers onto the underlying carrier delivery belt 35. Dispensing of carriers from the stack to the underneath carrier delivery belt is accomplished by a worm feed that is timed to supply carriers per machine speed demand. The separating and feeding means comprises a cantilevered frame 101 extending across the feeding station 98. A center aperture 102 in frame 101 provides a feed path for the stack of carriers. On the underside of frame 101 are mounted plural rotatable members 103 located at the corners of aperture 102. Each of the rotatable members 103 is constructed as shown on FIG. 6. A cylindrical barrel 104 is attached for rotation by the vertical shaft 105 and supported thereon by an adjusting collar 106. Barrel 104 includes a helical spline or groove 107 formed on its peripheral surface extending at least one full revolution on the barrel. As shown on FIG. 6, groove 107 extends approximately 360° circumferentially on barrel 104 and travels axially approximately the height of barrel 104. The groove size or width is just slightly more than the thickness of the peripheral flange 9b of the plastic carrier 9. The stack of carriers rests at its four corners by the lateral flange surface at **9*b* which fits into an opening to the grooves 107 so as to initially rest upon the land surface at 108 on one side of the groove. The top open portion for entry of the flange into the four helical grooves 107 occurs for a short peripheral span, say 80°–90°. Thereafter, the helical groove 107 is made up of the two axially spaced, parallel side walls. (See FIG. 5) The stack of nested carriers is compacted, and, as such, the carriers tend to stick together as a body. To first separate the lowermost carrier slightly from the rest of the stack, and, secondly, discharge this separated lowermost carrier vertically downwardly by gravity is achieved by rotation of the four rotary feed members 103 in unison. On FIG. 5, members 103** are rotated counter clockwise.

The members 103 are driven by a link chain 109 reeved around a drive sprocket 110 and the four driven sprockets 111 each attached on the upper end of one of the shafts 105 of the rotary members 103. Drive sprocket 110 is power rotated by a vertical shaft 112 supported in the sleeve bearing 113. Shaft 112 is the output of a right angle gear box 114 fastened on frame 69 and having a power input sprocket 115 driven by a chain 116 (FIG. 1), which is included in the synchronized drive system to be described presently. The drive shaft 112 is rotated continuously and for every revolution imparted to the rotary members 103 thereby, one carrier 9 is separated and fed from the bottom of the stack of carriers at the feeding station.

The stack of carriers is stabilized in the aperture by the hopper walls extending above the cantilever frame 101. The hopper is made of side wall plates 117 each flared outwardly at their upper ends and corner plates 118 interleaved between wall plates 117. Corner plates 118 are likewise flared outwardly at their upper ends, the combined structure 117 and 118 forming a funnel-like entry to the hopper. Below the frame 101 there is a pair of opposite, spaced-apart guide plates 119, which assure the drop of each carrier onto the underlying carrier delivery belt 35.

Carriers 9 are dropped singly and in succession onto the top horizontal reach of the carrier delivery belt 35 which is guided around the end pulleys 120 and 121 and an intermediate idler 122 that serves as an adjustable belt tensioning device. The pulleys and idler are rotatable on horizontal shafts that are rotatably bearing mounted in the opposed side plates 123 and 124, the side plate 124 being supported by the column of frame 69. Extending interiorly laterally between plates 123, 124 is a bent upper belt guide plate 125 (FIG. 1) which provides a guide surface for defining a horizontal span and an adjacent downwardly inclined span of the belt 35 on the upper course of its closed path, the inclined span extending onto pulley 121. The plate 125 also serves as a structural member to unify the delivery belt frame. Carrier delivery belt 35 is driven in a clockwise path (FIGS. 1 and 4) by chain 116 that is drivingly engaged with an end sprocket 126 keyed on the end of the mounting shaft for the belt end pulley 120. The chain 116 is powered by the drive system, and the belt 35 and rotary feed screws 103 are operated synchronously with each other.

As the carriers 9 are moved down the inclined section of belt 35, they are subject to confinement in a path into the gate end of the mechanism by the spaced side guides 127 extending parallel and above the side of belt 35 and the parallel, central top guide bar 128. Together, the inclined part of belt 35, guides 127 and 128 direct the carriers in a single line into carrier assembly gate 36, described earlier herein. The oncoming succession of bottles 10 processed into spaced, oriented groupings by the first star wheel means engages the forward edge of the carriers 9 by the front pair of bottles of the grouping and pulls them into a top assembly on the bottle grouping. The assembly of the carrier is performed by the applicator wheel 42 in the manner described earlier.

Drive System

Figure 8:
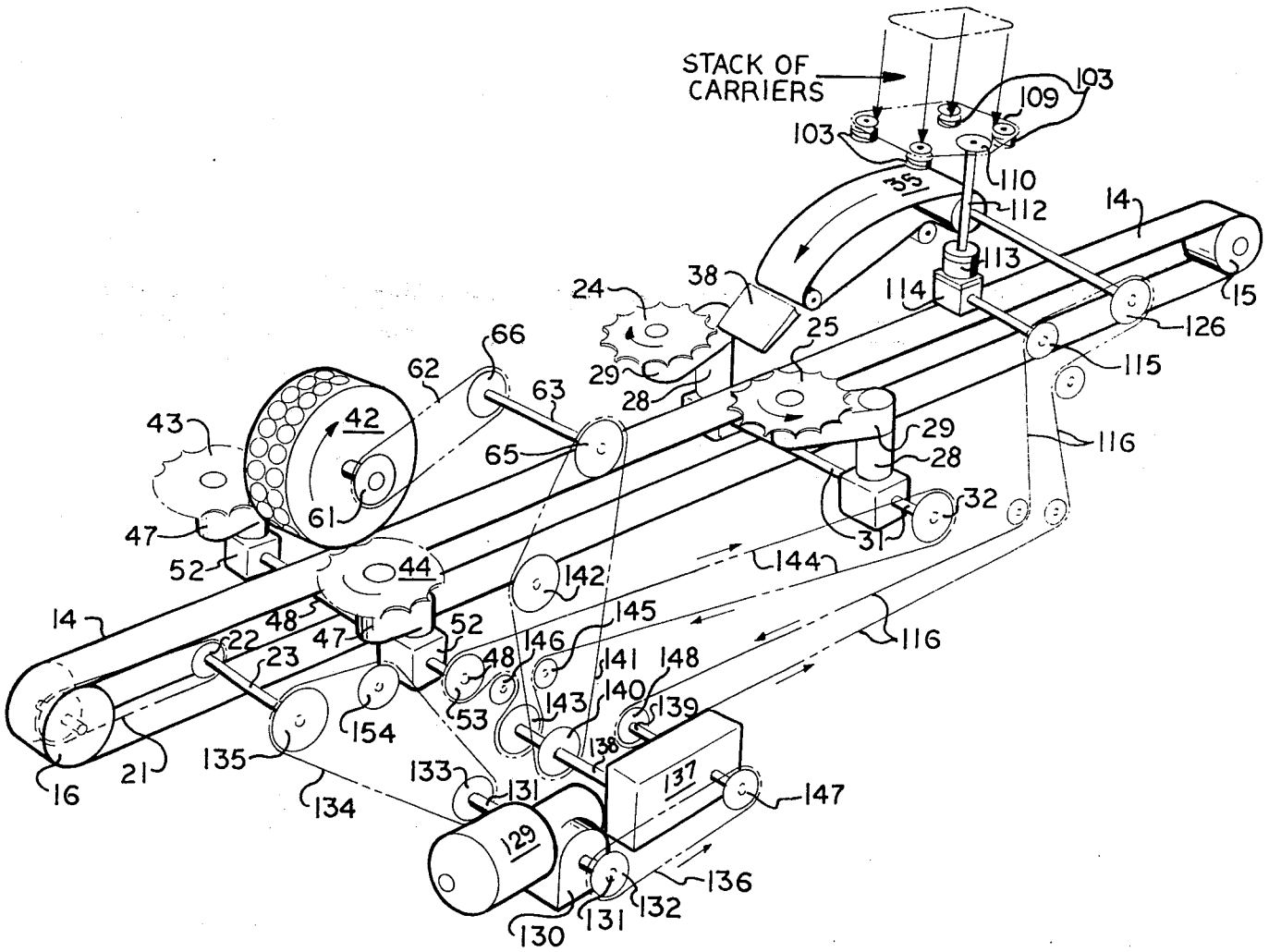
FIG. 8 is a partially schematic and perspective view of the drive system for the machine showing the means for operation of various machine components simultaneously and synchronously by a single motor.

The integrated drive system for the applicator machine and the carrier feed device is shown schematically on FIG. 8. All of the drive functions on the machine are integrally connected except for the indexing drive of magazine turret 70.

A main electric drive motor 129 is connected to drive a gear reduction unit 130 that reduces shaft speed of motor 129 to a ratio of about 26 to 1. A 1½ hp motor (129) sold by Westinghouse Electric Corp., Pittsburgh, Pennsylvania, including an SCR drive that provides controlled acceleration and deceleration, overload protection, jog and variable speed control is preferred. The power shaft 131 of unit 130 includes two spaced-apart drive gears 132 and 133 on the power shaft.

The one drive sprocket 133 drives a chain 134 that meshes with a sprocket 135 on shaft 23 and an idler gear 154, which operates bottle conveyor 14. The other drive sprocket 132 is operatively connected by chain 136 to input shaft of a geared transmission unit 137, such as sold by Eberhardt Denver Company, Model 2172.

Transmission 137 has two power output shafts 138 and 139. The first shaft 138 drives sprocket 140 in running engagement with a chain 141 connected about sprocket 65 and an idler 142. The chain 141 drives applicator wheel 42. A second sprocket 143 on shaft 138 is connected for driving a chain 144 that is reeved about a first idler 145, sprocket 32, sprocket 53 and a second idler 146. The chain 144 drives both the first and second star wheel means 24–25 and 43–44. Thus, the applicator wheel and two star wheel means controlling bottle movement therebeneath are powered from the same shaft (138).

The second output shaft 139 of the transmission has its drive sprocket 148 in running engagement with the chain 116 reeved about two idlers 149 and 150, then end sprocket 126 for the carrier belt drive, then input sprocket 115 for gear box 114, about an idler 151 and back to sprocket 148. The chain 116 drives the carrier delivery belt 35 and carrier feed screws 103 in unison.

Adjustable Carrier Delivery Belt

As described earlier herein, the end pulley 121 for the delivery belt 35 and the deadplate section 37 are mounted on the side plates 123 and 124. The vertical position of the carrier gate 36 is adjustable for various size or height of bottles 10 is acheived by the side plate extension 158 being connected by a pivot pin 155 onto the side plates 123 and 124. The extensions 158 are fastened in place by a bolt 156 thruogh arcuate slot 157. By unscrewing bolt 156, the side extension portions 158 carrying the shaft for the end roller 121 for the belt may be pivoted vertically up or down about the pin connection at 155 to adjust the height of end delivery of the conveyor for the carriers with relation to the bottles on the conveyor 14. The angular relation of side guides 127 and the central top guide bar 128 may be adjusted by set screw connections thereof on the frame in a manner well understood by those skilled in the art.

Although a specific emodiment has been shown and described, it is with full awaremess that many modifications thereof are possible within the skill of one versed in the art. The invention, therefore, is not to be restricted except insofar as is necessitated by the prior art and by the spirit and scope of the claims.

What is claimed as the invention is:

1. Apparatus for feeding a stack of shell-like carrier articles having a peripheral out-turned flange means thereon comprising a vertical chute defined by plural vertical walls, the interior perimeter of said chute being slightly larger than the perimeter of the articles permitting vertical flow of the articles therein, plural rotary feed means rotatably connected to the bottom end of said vertical chute depending below said wall structure thereof, said feed means being rotatable about vertical axes and having a helical means on each of said rotary feed means, a conveyor spaced vertically below the chute for receiving the articles fed from the chute comprising an endless traveling conveyor surface adapted to travel along an upper horizontal conveying span for receiving the articles, thence along a downwardly inclined span, around an end turn and along an underside return span, and a stationary assembly gate means mounted adjacent the end turn, said gate means adapted to receive carrier articles and arrest their movement on the traveling surface for dispensing them singly upon demand from the gate by a positive force applied to the carrier separate from the conveyor, the gate means comprising a downwardly inclined dead plate section terminating in a forward edge, an overhead hold down guide, means for yieldably pivotally mounting said guide in vertically spaced relation to said dead plate section, said yieldable means normally positioning the guide for engaging carriers moving onto said dead plate and holding them thereon whereby the front of the carrier extends beyond said forward edge, and said guide including an inclined segment extending longitudinally over at least a portion of said dead plate section and beyond its said forward edge, and an adjacent, normally horizontal terminal segment extending longitudinally and forwardly beyond said forward edge of the dead plate, drive means, means connecting the drive means to said plural rotary feed means for rotating the latter in unison in one direction of rotation for feeding articles one at a time from the stack in the chute, the helical means thereon positively guiding the articles from the lower end of the chute, and means connecting the drive means to said conveyor for moving the latter past the lower end of said chute and toward said gate means, the drive means operating the feed means and conveyor at a synchronous speed, whereby the carrier articles are fed vertically onto said conveyor in a line and moved by the conveyor onto said inclined dead plate of the gate means.

2. Apparatus for feeding a stack of shelllike articles having an out-turned peripheral flange thereon comprising a horizontal frame having a substantially rectangular aperture therein providing a feed path for the articles, four barrel members, each having a cylindrical body, individual vertical shafts connected for rotating each of said barrel members, each barrel member having a helical spline extending along the length of the barrel cylinder and describing at least one revolution on the circumferential surface of said body, said spline being open at the top and bottom ends, respectively, to receive and eject the flange portion of the articles, means for rotatably mounting said vertical shafts on the horizontal frame, each shaft being disposed adjacent a different corner of the frame aperture, whereby the barrel member engages the lowermost article of the stack and extends below the frame, said spline thereon supporting the lowermost article, a driven sprocket on each of the vertical shafts for rotating the latter, a drive shaft, a drive sprocket on said shaft, a flexible endless drive member in driving engagement with said drive sprocket and each said driven sprockets for rotating the latter in unison in one direction of rotation, a drive means connected for rotating said drive shaft, plural vertical wall plates fastened on the horizontal frame to extend vertically upwardly thereon and disposed adjacent the sides of said rectangular aperture in said frame, said plates collectively providing a funnel-like vertical chute permitting vertical flow by gravity of a stack of the articles contained therein, the lowermost articles engaging the wall of the helical spline of said four barrel members in the article feed path, the rotation of the barrel members in unison positively separating the lowermost article from the stack of articles and discharging it in the feed path below the lower end of the barrel members, a transverse conveyor spaced below the lower ends of said barrel members for receiving articles discharged from the stack comprising an endless traveling conveyor surface adapted to travel along an upper generally horizontal span for receiving the articles, around an end turn and along an underside return span, and a stationary gate means mounted adjacent the conveyor end turn, said gate means adapted to receive articles and arrest their movement on the traveling conveyor surface dispensing them singly upon demand from the gate, the gate means comprising a downwardly inclined dead plate section terminating in a forward edge, an overhead hold down member, means for yieldably mounting said guide in vertically spaced relation to said dead plate section, said yieldable means normally positioning said guide for engaging articles moving onto said dead plate and holding them thereon such that the front edge of the article extends beyond said forward edge of the dead plate, and means connecting said drive means to the conveyor for moving the latter past said barrel members, said drive means operating the barrel members and the conveyor at a speed for depositing the articles from the stack in a spaced-apart, end-to-end relationship on the conveyor, the latter transporting them in a line away from the vertical feed path and toward said gate means.

3. The apparatus defined in claim 2, wherein the underlying conveyor extends parallel with the horizontal frame, and including a pair of parallel lower vertical guide plates depending below said frame and connected to the horizontal frame adjacent two opposite sides of said aperture thereof disposed parallel with the path of said conveyor.

* * * * *